US006953302B1

(12) United States Patent
Kochling

(10) Patent No.: US 6,953,302 B1
(45) Date of Patent: Oct. 11, 2005

(54) ADJUSTMENT RISER FOR A MANHOLE FRAME

(76) Inventor: Edmund T. Kochling, 47 Hanson Rd., Charlton, MA (US) 01507

( * ) Notice: Subject to any disclaimer, the term of this patent is extended or adjusted under 35 U.S.C. 154(b) by 0 days.

(21) Appl. No.: 10/897,928

(22) Filed: Jul. 23, 2004

Related U.S. Application Data

(60) Provisional application No. 60/489,782, filed on Jul. 23, 2003.

(51) Int. Cl.[7] ..... E02D 29/14
(52) U.S. Cl. ..... 404/26; 52/20
(58) Field of Search ..... 52/19, 20; 404/25, 404/26

(56) References Cited

U.S. PATENT DOCUMENTS

| | | | | |
|---|---|---|---|---|
| 3,773,428 A | * | 11/1973 | Bowman | 404/26 |
| 3,858,998 A | * | 1/1975 | Larsson et al. | 404/26 |
| 4,149,816 A | * | 4/1979 | Piso | 404/26 |
| 4,925,337 A | * | 5/1990 | Spiess et al. | 404/26 |
| 5,513,926 A | * | 5/1996 | Prescott | 404/26 |
| 5,723,192 A | | 3/1998 | Jonasz | |
| 6,371,687 B1 | * | 4/2002 | Heintz et al. | 404/26 |
| 6,811,350 B2 | * | 11/2004 | Nadasde | 404/26 |

FOREIGN PATENT DOCUMENTS

JP 62021933 A * 1/1987 ..... E02D 29/12

* cited by examiner

*Primary Examiner*—Thomas B. Will
*Assistant Examiner*—Alexandra Pechhold
(74) *Attorney, Agent, or Firm*—Kriegsman & Kriegsman

(57) ABSTRACT

An adjustment riser is disposed between a manhole and a frame embedded in the paved surface of a roadway. The adjustment riser includes an annular concrete base which includes substantially flat top and bottom surfaces. A ridge and a groove are formed on the top and bottom surfaces, respectively, of the base to facilitate in the stacking of multiple risers and to prevent water infiltration. The adjustment riser additionally includes a plurality of adjustable support assemblies for supporting the frame. Each support assembly includes a support which extends axially within a corresponding bore formed in the base. Each support includes an enlarged head shaped to support the frame, the vertical position of the head of the support relative to the top surface of the base being continuously adjustable. In this manner, the adjustable nature of each support enables riser to hold the frame in its proper orientation relative to the paved surface.

18 Claims, 6 Drawing Sheets

ADJUSTMENT RISER FOR A MANHOLE FRAME

CROSS-REFERENCE TO RELATED APPLICATIONS

The present application claims the benefit under 35 U.S.C. 119(e) of U.S. Provisional Patent Application Ser. No. 60/489,782, filed Jul. 23, 2003, the disclosure of which is incorporated herein by reference.

BACKGROUND OF THE INVENTION

The present invention relates generally to manhole assemblies and more particularly to adjustment risers for a manhole frame, a catch basin frame or the like.

A manhole is a structure which provides a passageway into an underground system (e.g., an underground drainage, sewage, electrical, telephone or cable system). In this manner, a manhole (also commonly referred to in the art as a maintenance hole) enables a worker to descend into the underground system for the purpose of performing routine maintenance and/or servicing, which is highly desirable.

A manhole typically enables one to descend down into an underground system from a paved surface, such as a street. Referring now to FIG. 1, there is shown an exploded view of a manhole assembly 10 that extends from a paved surface (not shown) down into an underground system (not shown). Specifically, assembly 10 includes an elongated pre-cast manhole 11, manhole 11 extending vertically up from an underground system to a location spaced adequately beneath the paved surface. Manhole 11 is shaped to include a central opening 13 which is sized and shaped to enable a worker to pass therethrough. Commonly, one or more steps and/or handles are affixed onto the inner surface of manhole 11 to help the worker to travel through central opening 13.

One or more annular concrete risers 15 are stacked directly on top of pre-cast manhole 11, the lowermost riser 15-1 being affixed to the top surface of manhole 11 by a layer of sealant, such as tar or any other conventional caulking material, to limit water infiltration. The central hole in each riser 15 is preferably axially aligned with the central opening 13 in manhole 11 so as to create a continuous passageway through which a worker can pass. Each riser 15 (also commonly referred to in the art as an adjustment riser) is typically constructed of a concrete material so as to render it less susceptible to cracking and/or salt damage.

Furthermore, a manhole frame 17 is disposed directly above the uppermost riser 15-2. The manhole frame 17 is typically constructed of a rigid and durable material, such as cast-iron, and includes a flat annular platform 19 and an annular ring 21 which extends orthogonally up from platform 19. The annular ring 21 is commonly provided with an inwardly protruding flange 23 which is sized and shaped to support a disc-shaped manhole cover 25. Preferably, manhole cover 25 is sized and shaped to fit snugly within the opening defined by ring 21, with the top surface of manhole cover 25 lying flush with the top surface of ring 21. In this manner, it is to be understood that manhole cover 25 serves as a means for enclosing the passageway into the underground system at the street level, thereby rendering the street safe for traffic when access to the underground system is not required.

Ideally, the top surface of the manhole frame 17 (and similarly the manhole cover 25) lies substantially flush with the paved surface. Failure to position the top surface of manhole frame 17 flush with the paved surface can cause considerable cracking and/or pitting between frame 17 and the paved surface over time (i.e., due to stress and vibratory forces created from traffic traveling on the paved surface). As can be appreciated, cracking and/or pitting of the paved surface immediately surrounding frame 17 can lead to excessive water infiltration into the underground system and/or the formation of substantial potholes in the paved surface, both of which are highly undesirable.

Accordingly, an intermediate layer of material (not shown) is typically provided between the uppermost riser 15-2 and the underside of platform 19 of manhole frame 17 to ensure that the top surface of manhole frame 17 (as well as manhole cover 23) lies substantially flush with the paved surface. This intermediate layer is often constructed using either concrete or the combination of brick and mortar.

It should be noted that town, city and/or state construction ordinances often mandate that the distance D between the top surface of manhole 11 and the top surface of frame 17 (i.e., the surface of the roadway) be a specified minimum value (e.g., 12 inches) to allow for future work on the roadway (e.g., repaving the surface) without damaging the manhole 11. Specifically, in order to repave a roadway, considerable pulverization of the paved surface is typically required. As such, prior to the pulverization of the paved surface, workers are required to break away the intermediate layer and, in turn, remove the risers 15 and frame 17. Once the risers 15 and frame 17 have been removed, the pavement is typically pulverized down to the top surface of the manhole 11.

The aforementioned intermediate layer is typically formed between the uppermost riser 15-2 and the manhole frame 17 in the following manner. Specifically, after the one or more risers 15 have been positioned on top of the manhole 11 (using a crane or other similar machine) and sealed thereto, the intermediate layer is then deposited on top of the uppermost riser 15-2, the particular height of said intermediate layer being calculated so that the top surface of manhole frame 17 will lie flush with the paved surface. Before said intermediate layer has an opportunity to fully cure (i.e., harden), frame 17 is deposited thereon. Accordingly, once said intermediate layer cures, frame 17 is effectively secured onto uppermost riser 15-2 in a manner which prevents the infiltration of water into the underground system.

It has been found that the use of such an intermediate layer of material between the uppermost riser and the manhole frame introduces a number of notable drawbacks.

As a first drawback, it has been found that the considerable weight of the manhole frame often compresses the intermediate layer before it has an opportunity to cure. As a result, the top surface of the manhole frame often fails to lie flush with the paved surface, which is highly undesirable for the reasons noted in detail above.

As a second drawback, the aforementioned method of depositing said intermediate layer of material between the uppermost riser and the manhole frame has been found to be inadequate when the paved surface is not flat. In particular, paved surfaces are often crowned in the lateral direction (i.e., bowed such that its center is raised slightly higher than along its sides) to promote proper drainage. As a result, the frame is often shimmed at an angle relative to the uppermost riser (so as to be flush with the bowed pavement around its entire periphery) using construction remnants, shards of concrete and/or other debris. However, it has been found that the inaccurate nature of such a shimming technique can cause deterioration (i.e., cracking and pitting) in the paved surface around the frame, which is highly undesirable for the reasons noted in detail above.

As a third drawback, the utilization of products in said intermediate layer which require a significant curing period (e.g., concrete, mortar, etc.) necessitates that the deposition of said layer be undertaken only during ideal weather conditions, which is highly undesirable.

As a fourth drawback, said intermediate layer is typically constructed out of a material which is not reusable. Accordingly, when road construction is performed which necessitates the separation and removal of the frame and risers from the manhole, subsequent reconstruction of the manhole with its complementary parts necessitates the complete reconstruction of the intermediate layer, which is highly undesirable.

Accordingly, rubber (or rubber composite) adjustment risers are well known in the art and are commonly used as a means to orientate the top surface of a manhole frame flush with the paved surface. Rubber adjustment risers are commonly constructed as thin, unitary rings which are relatively fixed in shape (an example of a rubber composite adjustment riser being shown in U.S. Pat. No. 5,723,192 to S. Jonasz, which is incorporated herein by reference). In use, one or more rubber adjustment risers are stacked between the uppermost riser and the manhole frame so as to render the top surface of the frame flush with the paved surface, the rubber construction of said risers serving as a gasket for limiting water infiltration. It should be noted that rubber adjustment risers of the type described above are often constructed either: (1) with substantially flat and parallel top and bottom surfaces or (2) with a substantially flat bottom surface and with an angled, or tapered, top surface so as to provide the riser with a wedge-like construction for use with paved surfaces which are not flat.

Although well-known in the art, rubber adjustment risers of the type described above suffer from a few notable drawbacks.

As a first drawback, rubber adjustment risers of the type described above are relatively fixed in shape. Because a paved surface frequently has a unique contour, the preformed shape of an rubber adjustment riser often fails to precisely align the top surface of the manhole frame flush with the pavement, which is highly undesirable. Furthermore, the large variety of differently sized and shaped rubber adjustment risers increases the storage requirements of its user, which is highly undesirable.

As a second drawback, a rubber adjustment riser of the type described above has a certain level of compressibility. Due to its compressibility, it has been found that the rubber adjustment riser often acts as a shock absorber for traffic passing on the paved surface which, in turn, eventually disturbs the pavement area immediately surrounding the manhole frame, which is highly undesirable.

As a third drawback, it has been found that rubber adjustment risers of the type described above are not as effective in preventing the infiltration of water into the underground system as concrete or the combination of brick and mortar, which is highly undesirable.

As a fourth drawback, it has been found that rubber adjustment risers of the type described above are not considerably durable. Rather, rubber adjustment risers have been found to be susceptible to deformation and/or breakage when subjected to the vibratory forces produced from strenuous road conditions, which is highly undesirable.

SUMMARY OF THE INVENTION

It is an object of the present invention to provide a novel adjustment riser for a frame, such as a manhole frame, a catch basin frame or the like.

It is yet another object of the present invention to provide an adjustment riser of the type described above which can be used to accurately orient the top surface of a manhole frame flush with the paved surface in which it is disposed.

It is still another object of the present invention to provide an adjustment riser of the type described above which can be used with a wide variety of differently contoured paved surfaces.

It is yet still another object of the present invention to provide an adjustment riser of the type described above which has a limited number of parts, which is inexpensive to manufacture and which is easy to use.

It is even still another object of the present invention to provide an adjustment riser of the type described above which is rigid and durable.

Accordingly, there is provided an adjustment riser for a frame, such as a manhole frame, said adjustment riser comprising a base, said base including a top surface and a bottom surface, said base being shaped to define an central opening and a first adjustable support assembly coupled to said base, said first adjustable support assembly comprising a support adapted for vertical displacement relative to said base.

The present invention is also directed to a manhole assembly comprising an adjustment riser of the type described above.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
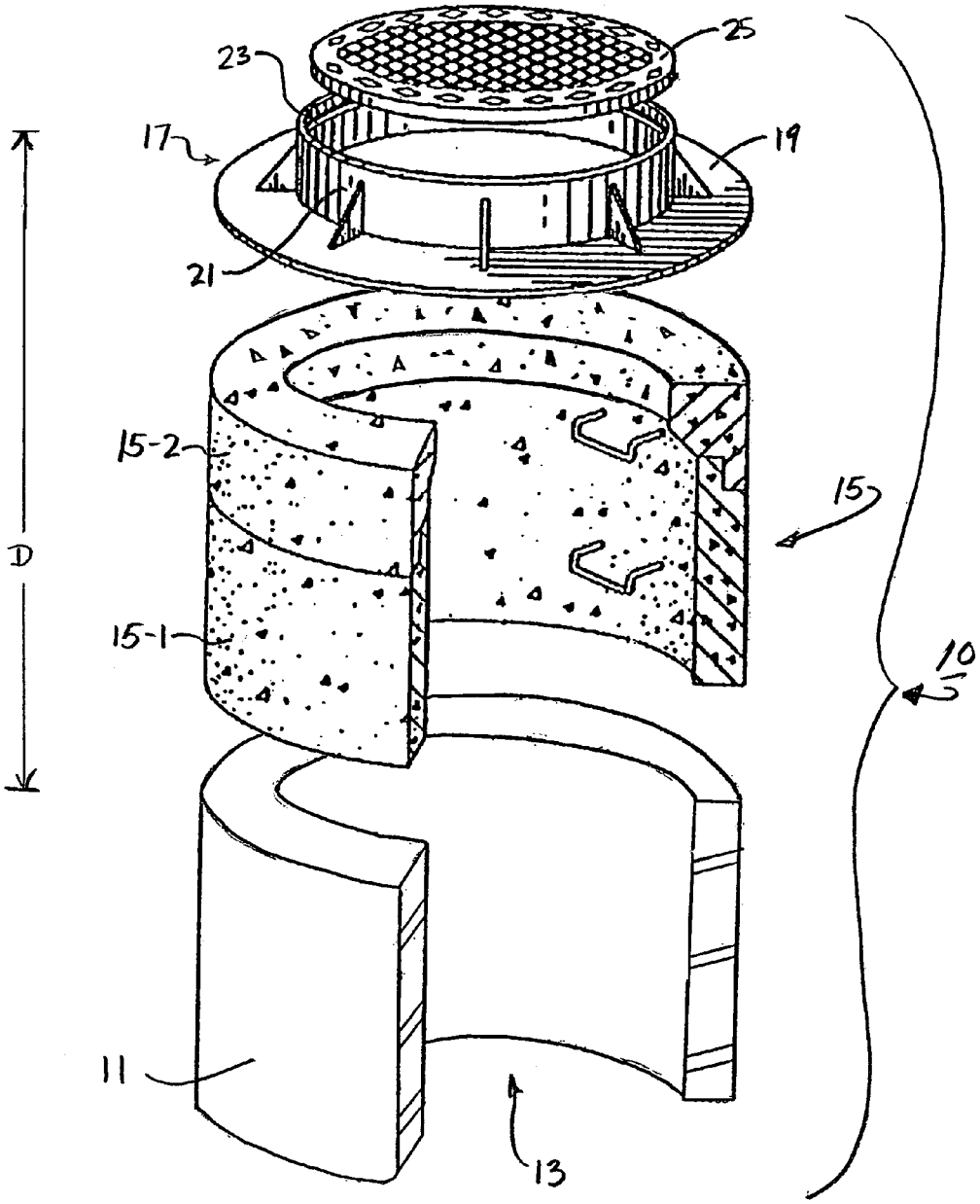
PRIOR ART FIG. 1
FIG. 1 is an exploded top perspective view of a conventional manhole assembly including a manhole, a pair of stacked adjustment risers, a manhole frame and a manhole cover, the manhole and the pair of stacked adjustment risers being shown broken away in part.
Figure 2:
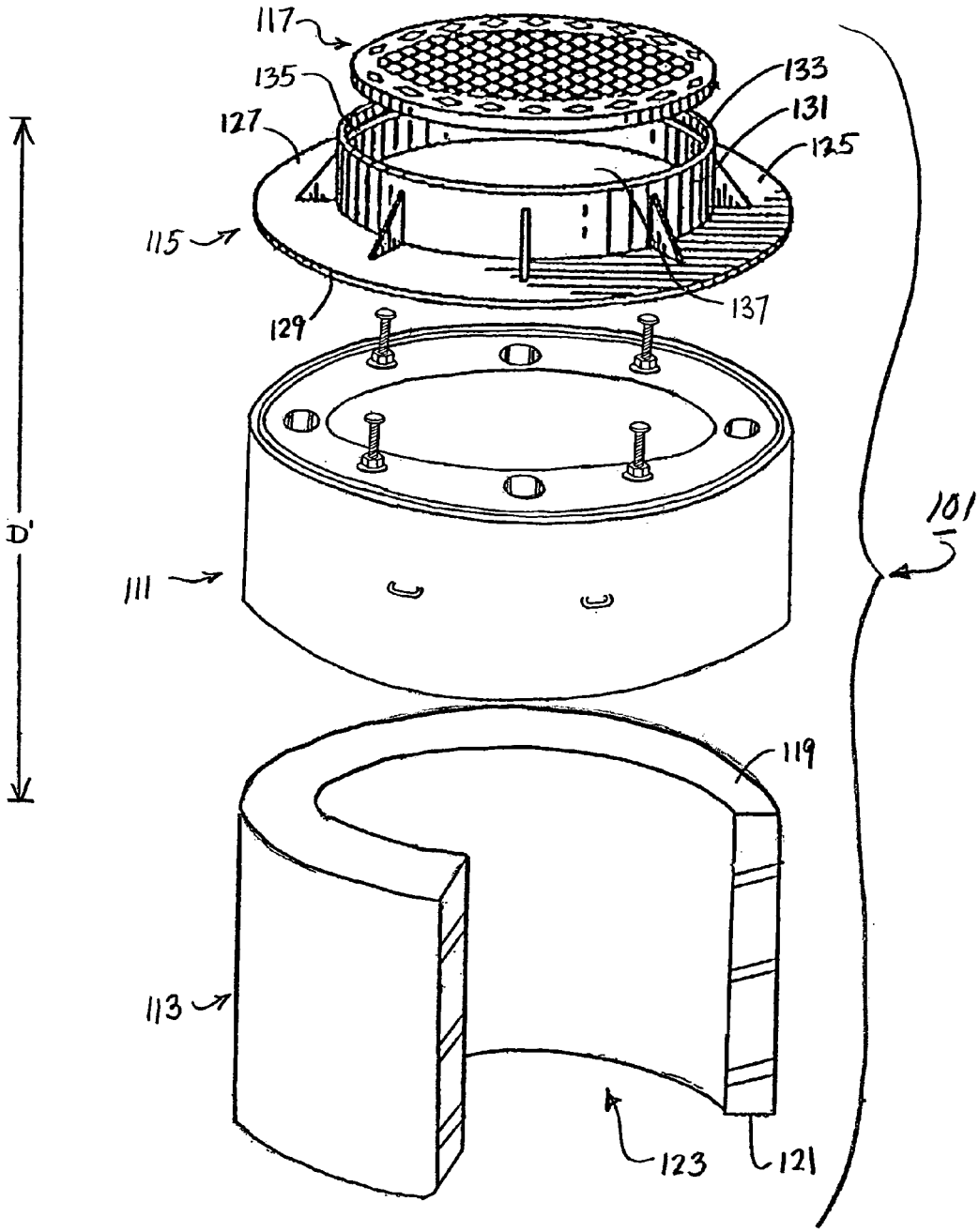
FIG. 2 is an exploded top perspective view of a manhole assembly constructed according to the teachings of the present invention, the manhole of the manhole assembly being shown broken away in part.
Figure 3:
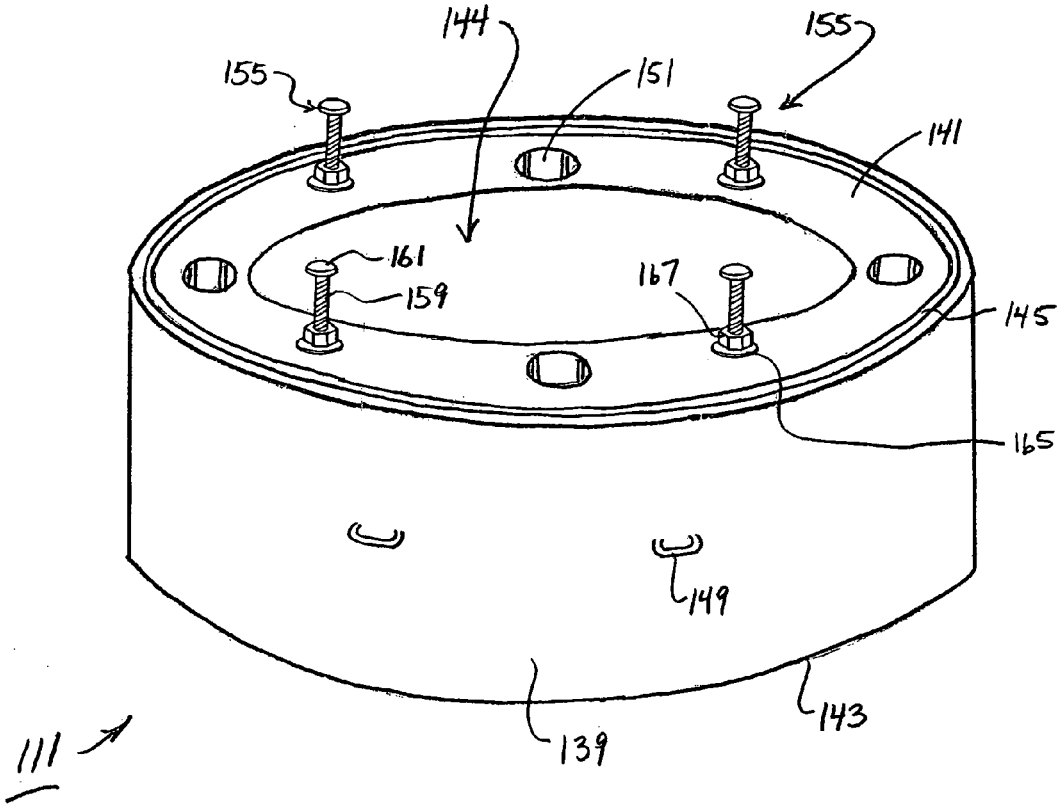
FIG. 3 is a top perspective view of the adjustment riser shown in FIG. 2.
Figure 4:
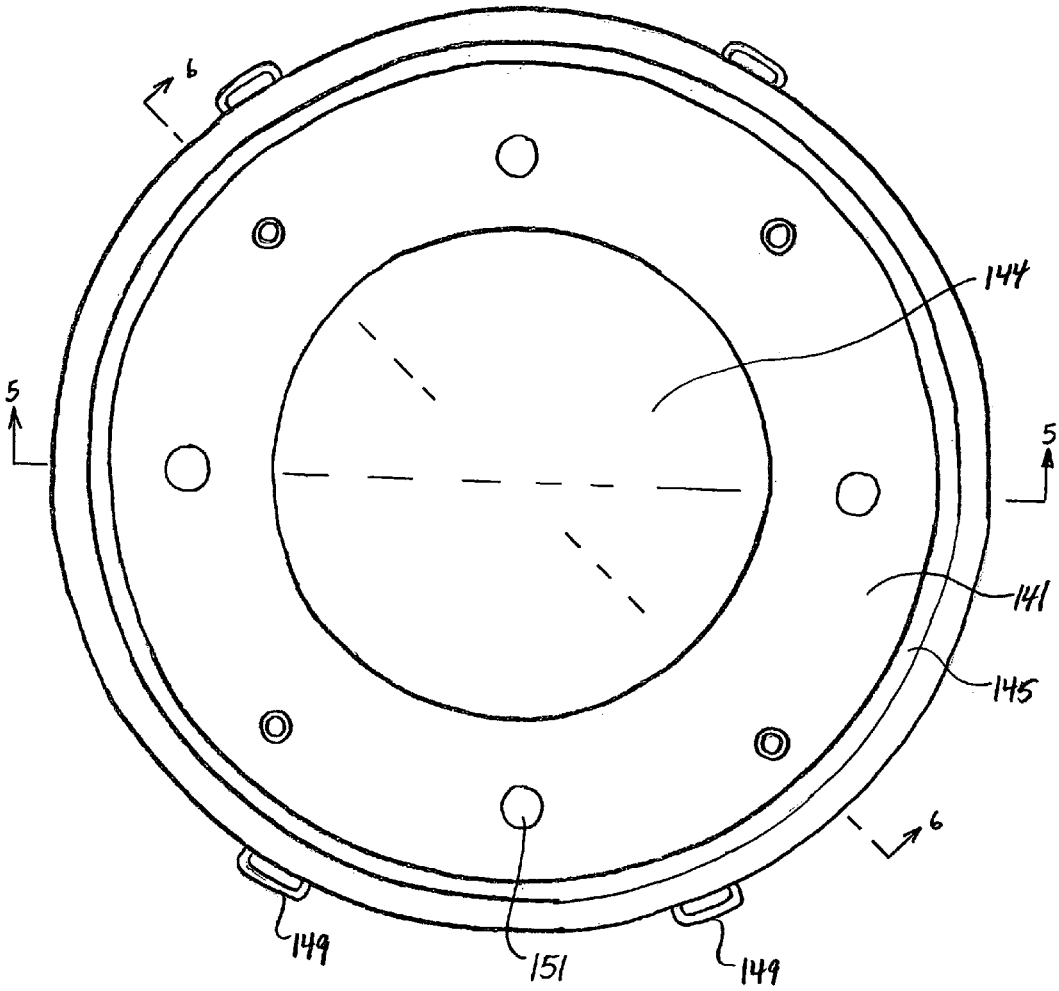
FIG. 4 is a top plan view of the adjustment riser shown in FIG. 2.

Referring now to FIG. 2, there is shown an exploded top perspective view of a manhole assembly constructed according to the teachings of the present invention and identified generally by reference numeral 101.

Manhole assembly 101 comprises an adjustment riser 111, a manhole 113, a manhole frame 115 and a manhole cover 117. As will be described further below, adjustment riser 111 serves two principal functions: (1) to space the top surface of frame 115 a minimum distance D' away from manhole 113 (as often mandated by city, town and/or state construction ordinances) and (2) to orient frame 115 so that its top surface lies flush with the paved surface (not shown) in which it is embedded.

Manhole 113, which may be identical to manhole 11 of assembly 10, is designed to permit access into an underground system. Preferably, manhole 113 is in the form of an elongated pre-cast structure which extends vertically up from an underground system (not shown) to a location spaced adequately beneath a paved surface (not shown). Manhole 113 is shown herein as having a cylindrical shape with a substantially flat top surface 119 and a substantially flat bottom surface 121, manhole 113 being shaped to define a central opening 123 which is sized and shaped to enable a worker to pass therethrough. However, it is to be understood that manhole 113 is not limited to any particular size, shape and/or construction.

Frame 115, which may be identical to frame 17 of assembly 10, is adapted to be embedded within a paved surface and is shaped to define a street level opening leading down into an underground system. Frame 115, which is preferably constructed of a rigid and durable material, such as steel, comprises a thin annular platform 125 that includes a substantially flat top surface 127 and a substantially flat bottom surface 129. An annular ring 131 extends orthogonally up from top surface 127 of platform 125 and includes a free end 133. An inwardly protruding flange 135 is formed along the inner surface of ring 131 in close proximity to free end 133. Together, platform 125 and ring 131 define a central opening 137 which is generally circular in lateral cross-section.

Preferably, frame 115 is embedded within the top surface of a paved roadway such that central opening 137 axially aligns with opening 123 in structure 113 to provide an elongated continuous passageway into the underground system. In ideal conditions, frame 115 is embedded such that free end 133 lies flush with the top surface of the paved roadway. As can be appreciated, failure to accurately align free end 133 flush with the top surface of the paved roadway can lead, in time, to a considerable degree of cracking and/or pitting in the paved roadway immediately surrounding frame 115 (due to stress and vibratory forces created from traffic traveling on the paved surface), which is highly undesirable.

Cover 117, which may be identical to cover 25 of assembly 10, is used for safety purposes to at least partially enclose at street level a passageway down into an underground system. Cover 117 is preferably constructed of a rigid and durable material, such as steel, and is represented herein as being in the form of a solid, disc-shaped piece. Cover 117 is adapted to be removably mounted on flange 135. With cover 117 mounted on flange 135, cover 117 is sized and shaped to substantially enclose central opening 137, the thickness of cover 117 being such that its top surface lies flush with the free end 133 of frame 115.

Riser 111 is designed to be positioned between manhole 113 and frame 115, as depicted in FIG. 2. With riser 111 disposed between manhole 113 and frame 115, it is to be understood that riser 111 serves two primary functions.

First, riser 111 serves to space the top edge (i.e., free end 133) of frame 115 a minimum distance D' away from top surface 119 of manhole 113 (as often mandated by construction ordinances). In this manner, future roadwork on the paved surface which requires substantial pulverization (e.g., repaving) can be performed by removing frame 115 and riser 111 and without damaging manhole 113 (which is permanently fixed in place in the ground).

Second, riser 111 serves as an adjustment device for orienting the top edge (i.e., free end 133) of frame 115 flush with the paved surface in which it is embedded, as will be described further below.

Referring now to FIGS. 3 through 7, adjustment riser 111 comprises a ring-shaped base 139. Preferably, base 139 is constructed out of a steel reinforced, 5000 psi concrete material so as to render it less susceptible to cracking and/or salt damage. Base 139 includes a substantially flat top surface 141 and substantially flat bottom surface 143 and is shaped to define a central opening 144 which is generally circular in lateral cross-section.

Figure 5:
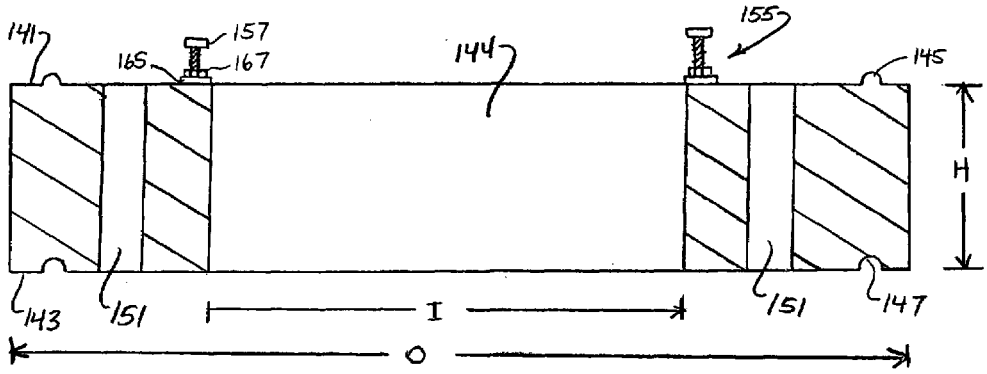
FIG. 5 is a section view of the adjustment riser shown in FIG. 4 taken along lines 5—5.
Figure 6:
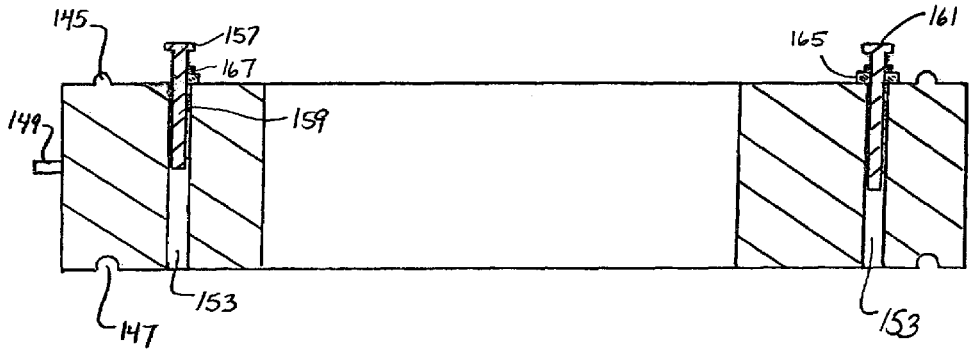
FIG. 6 is a section view of the adjustment riser shown in FIG. 4 taken along lines 6—6.

As seen most clearly in FIG. 5, base 139 preferably has an outer diameter O of approximately 50 inches, an inner diameter I of approximately 26 inches and a height H of approximately 5.5 inches. However, it should be noted that base 139 is not limited to any particular set of dimensions. Rather, it is to be understood that the dimensions of base 139 could be modified (e.g., reducing height H to 3.5 inches) to enable riser 111 to be used in conjunction with a wide variety of differently sized structures without departing from the spirit of the present invention.

An annular ridge 145 is preferably formed on top surface of 141 of base 139. Similarly, an annular groove 147 is preferably formed into bottom surface 143 of base 139. As can be appreciated, ridge 145 and groove 147 together facilitate the stacking of multiple risers 111 on top of one another in proper axial alignment. Specifically, for a pair of stacked risers 111, the ridge 145 on the lower riser 111 is sized and shaped to fittingly protrude into the groove 147 in the upper riser 111, the fitting interrelationship of parts serving to retain the pair of risers 111 in the proper stacked configuration. In addition, the fitting interrelationship of ridge 145 of one riser 111 and groove 147 of another riser 111 prevents water infiltration across top surface 141, thereby providing a water-tight seal between risers 111.

Preferably, ridge 145 is formed approximately 2.0 inches in from the outer wall of base 139 and has a height of approximately 0.75 inches and a width of approximately 1.5 inches. Similarly, groove 147 is preferably formed approximately 2.0 inches in from the outer wall of base 139 and has a depth and width which is slightly greater than the height and width, respectively, of ridge 145. However, it is to be understood that the particular size, shape and dimensions of ridge 145 and groove 147 could be modified without departing from the spirit of the present invention.

A plurality of handles 149 preferably extend out from the outer surface of base 139 in a spaced apart relationship. As can be appreciated, handles 149 (also referred to herein as lifting rings) facilitate moving riser 111 (e.g., using a crane or other similar piece of machinery).

A plurality of cavity-thru holes 151 are formed in base 139 in a spaced apart relationship. Each hole 151 is generally circular in lateral cross-section and extends longitudinally through base 139 from top surface 141 to bottom surface 143. As can be appreciated, the implementation of holes 151 into base 139 serves to reduce the overall weight of adjustment riser 111, thereby allowing for greater ease in its handling, which is highly desirable.

In addition, a plurality of bores 153 are formed in base 139, bores 153 being equidistantly spaced apart from one another. Each bore 153 is generally circular in lateral cross-section and extends longitudinally through base 139 from top surface 141 to bottom surface 143. However, it is to be understood that bores 153 could alternatively extend down from top surface 141 to a location above bottom surface 143 without departing from the spirit of the present invention.

Each bore 153 is adapted to receive an adjustable support assembly 155. Together, adjustable support assemblies 155 for riser 111 serve to support frame 115 in its proper orientation while an intermediate layer of curable material (e.g., concrete) is deposited therebetween. As will be described further below, the relative position of each support assembly 155 within its corresponding bore 153 can be vertically adjusted in order to accurately maintain the top edge 135 of frame 115 flush with the top surface of the paved roadway, which is a principal object of the present invention.

Figure 7:
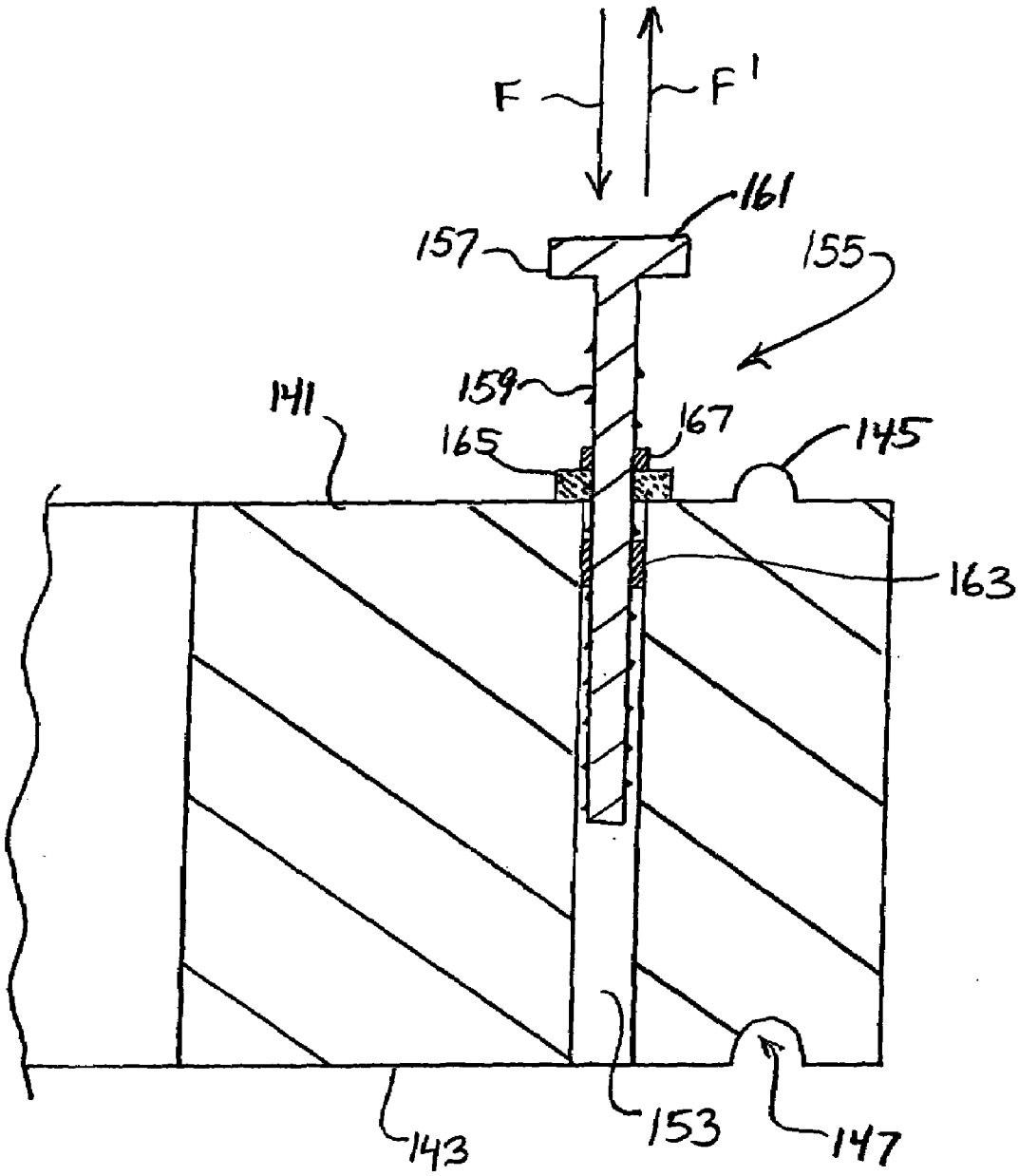
FIG. 7 is an enlarged, fragmentary view of the adjustment riser shown in FIG. 6.

As seen most clearly in FIG. 7, each adjustable support assembly 155 includes an adjustable support 157 which at least partially extends axially within its corresponding bore 153. Each adjustable support 157 is adapted for substantially continuous, linear displacement within bore 153 in both the downward direction (as represented by arrow F in FIG. 7) and in the upward direction (as represented by arrow F' in FIG. 7). As a result, the ability to vertically adjust the relative position of each support 157 within its corresponding bore 153 enables riser 111 to support frame 115 in a wide range of possible orientations, which is highly desirable.

Each adjustable support 157 is represented herein as being in the form of a bolt which comprises an elongated, threaded stem 159 and an enlarged, substantially flat head 161 formed on one end of stem 159. Adjustable support 157 is sized and shaped such that stem 159 extends axially within its corresponding bore 153 with enlarged head 161 disposed above top surface 141 of base 139. However, it should be noted that support 157 is not limited to this particular design. Rather, it is to be understood that support 157 represents any type of support member which includes a head (or other similar type of support platform) that can be vertically adjusted towards and/or away from top surface 141 of base 139.

Preferably, a threaded nut 163 is fixedly wedged within bore 153 proximate top surface 141. Nut 163 is sized and shaped to threadingly receive stem 159 of its corresponding support 157. In this manner, the threaded engagement between support 157 and its corresponding nut 163 enables support 157 to be vertically displaced (in an incremental manner) through the rotation of support 157 (e.g., using a wrench or other similar instrument).

In addition, a washer 165 and a threaded nut 167 are axially mounted on stem 159 above top surface 141 of base 139, nut 167 being in threaded engagement with stem 159. Together, washer 165 and threaded nut 167 serve as a lock, or stop, for limiting the downward displacement of support 157. Specifically, with support 157 rotated to its desired position, washer 165 is axially displaced along stem 159 until it is drawn in direct contact against top surface 141. With washer 165 disposed against top surface 141, nut 167 is rotated until it is drawn in strong contact against washer 165. With washer 165 and nut 167 positioned as such, support 157 can no longer be displaced in the downward direction. As such, with the weight of frame 115 transferred onto each support 157, washer 165 and nut 167 serve to ensure that support 157 remains fixed in place, which is highly desirable.

Adjustment riser 111 can be used in the following manner to support frame 115 at a particular orientation and at a distance spaced adequately away from manhole 113. Specifically, with manhole 113 permanently formed in the ground, riser 111 is stacked directly onto top of manhole 113, with central opening 144 in base 139 disposed in axial alignment with central opening 123 in structure 113. Adjustment riser 111 is stacked such that bottom surface 143 is drawn into direct contact with top surface 119 of manhole 113. Preferably, a layer of sealant (e.g., tar or any other conventional caulking material) is deposited between bottom surface 143 and top surface 119 to limit water infiltration between riser 111 and manhole 113.

It should be noted that additional risers (preferably without assemblies 155) may be stacked under riser 111 in those situations where the top surface 119 of manhole 113 is disposed a considerable distance beneath the paved surface. In this manner, one or more stacked risers 111 can be used to ensure that distance D' complies with applicable construction ordinances.

With riser 111 stacked on top of manhole 113, the user vertically adjusts each of the individual supports 157 such that, with bottom surface 129 of platform 125 resting on top of each head 161, top edge 133 of frame 115 lies flush with the paved surface. After each support 157 has been adjusted to its proper position, its corresponding washer 165 and nut 167 are tightly secured against top surface 141 of base 139 to fix, or lock, in place the vertical position of support 157.

With frame 115 removed from adjustment riser 111, a layer of curable material (e.g., concrete or the combination of brick and mortar) is deposited on adjustment riser 111. Preferably, the layer of curable material is deposited on top surface 141 and extends just past head 161 of each support 157. Before the layer of curable material has an opportunity to fully harden, frame 115 is mounted directly thereon. Due to the considerable weight of frame 115, the layer of curable material will compress until bottom surface 129 of frame 115 is drawn in contact against head 161 of supports 157. With bottom surface 129 of platform 125 disposed on top of heads 161, supports 157 serve to maintain frame 115 in its proper orientation (i.e., such that free end 133 of frame 115 lies flush with the paved surface). Once the layer of curable material finally hardens, the layer of curable material supports frame 115 (rather than supports 157) and creates an effective water resistant seal between frame 115 and riser 111, which is highly desirable.

The embodiment shown of the present invention is intended to be merely exemplary and those skilled in the art shall be able to make numerous variations and modifications to them without departing from the spirit of the present invention. All such variations and modifications are intended to be within the scope of the present invention as defined in the appended claims. For example, although the present adjustment riser has been described in the context of a manhole assembly, it should be noted that said adjustment riser could alternatively be used in a catch basin assembly, a valve chamber assembly or the like (with, for example, manhole 113, frame 115 and cover 117 being replaced with a catch basin, a catch basin frame and a catch basin cover, respectively).

What is claimed is:

1. An adjustment riser for a frame, said adjustment riser comprising:

(a) a base, said base including a top surface and a bottom surface, said base being shaped to define an central opening, wherein a bore is formed in said base, the bore extending down from the top surface of the base, and (b) a first adjustable support assembly coupled to said base, said first adjustable support assembly comprising (i) a support, said support including an elongated, threaded stem and a head, said head being disposed at one end of said elongated, threaded stem and being adapted to at least partially support said frame, the elongated, threaded stem being sized and shaped to extend axially within the bore, with the head disposed above the top surface of the base;

(ii) a first threaded nut wedged within the bore, the first threaded nut being sized and shaped to threadingly receive the elongated threaded stem of the support; and (iii) a second threaded nut, said second threaded nut being axially mounted on the elongated threaded stem of the support above the top surface of the base.

2. The adjustment riser of claim 1 wherein the vertical position of the head of the support relative to the top surface of the base is adjustable.

3. The adjustment riser of claim 1 wherein the support is capable of substantially continuous, linear displacement within the bore.

4. The adjustment riser of claim 1 wherein the top and bottom surfaces of said base are substantially flat.

5. The adjustment riser of claim 1 wherein said base is constructed out of a concrete material.

6. The adjustment riser of claim 1 wherein said base is annular in shape.

7. The adjustment riser of claim 1 wherein a ridge is formed on the top surface of said base and a groove is formed on the bottom surface of said base, said groove being complementarily shaped and positioned relative to said ridge so that a plurality of bases may be stacked upon one another, with the ridge of a lower base being received within the groove of an upper base.

8. The adjustment riser of claim 6 wherein said base has an outer diameter of approximately 50 inches, an inner diameter of approximately 26 inches and a height of approximately 3.5–5.5 inches.

9. An adjustment riser for a frame, said adjustment riser comprising:

(a) a base, said base including a top surface and a bottom surface, said base being shaped to define an central opening, wherein a bore is formed in said base, the bore extending down from the top surface of the base; and (b) a first adjustable support assembly coupled to said base, said first adjustable support assembly comprising a support adapted for vertical displacement relative to said base, said support including an elongated, threaded stem and a head, said head being formed on one end of said elongated, threaded stem and being adapted to at least partially support said frame, the vertical position of the head of the support relative to the top surface of the base being adjustable, wherein the elongated, threaded stem is sized and shaped to extend axially within the bore for substantially continuous, linear displacement within the bore, with the head disposed above the top surface of the base.

10. The adjustment riser of claim 9 wherein a first threaded nut is wedged within the bore, the nut being sized and shaped to threadingly receive the stem of the support.

11. The adjustment riser of claim 10 further comprising a washer and a second threaded nut, the washer and the second threaded nut being axially mounted on the stem of the support above the top surface of the base.

12. The adjustment riser of claim 11 wherein the washer and the second threaded nut can be used to limit the downward displacement of the support relative to said base.

13. An adjustment riser for a frame, said adjustment riser comprising:

(a) a base, said base including a top surface and a bottom surface, a ridge being formed on the top surface of said base, a groove being formed on the bottom surface of said base, wherein the groove is sized and shaped to fittingly receive the ridge to provide a water-tight seal therebetween, said base being shaped to define an central opening, and (b) a first adjustable support assembly coupled to said base, said first adjustable support assembly comprising a support adapted for vertical displacement relative to said base.

14. A manhole assembly comprising:

(a) a manhole;

(b) a manhole frame positioned over said manhole, said manhole frame comprising an annular ring and a platform extending radially outwardly from said annular ring; and (c) an adjustment riser positioned between said manhole and said manhole frame, said adjustment riser comprising:

(i) a base positioned over said manhole, said base including a top surface and a bottom surface, said base being shaped to define an central opening, and (ii) a first adjustable support assembly coupled to said base, said first adjustable support assembly comprising a first support adapted for adjustable vertical displacement relative to said base, said manhole frame being supported by said first support.

15. The manhole assembly as claimed in claim 14 wherein said adjustment riser further comprises a second adjustable support assembly coupled to said base, said second adjustable support assembly comprising a second support adapted for adjustable vertical displacement relative to said base, said manhole frame also being supported by said second support.

16. The manhole assembly as claimed in claim 15 further comprising a manhole cover removably mountable within said manhole frame.

17. The manhole assembly as claimed in claim 14 wherein said manhole is a pre-cast structure having a generally cylindrical shape provided with a central opening.

18. The manhole assembly as claimed in claim 14 wherein said base includes a bore extending downwardly from the top surface thereof and wherein said first adjustable support assembly further comprises a first threaded nut wedged within said bore, said first support including an elongated, threaded stem and a head, said head being disposed at one end of said elongated, threaded stem and being adapted to at least partially support said manhole frame, the elongated, threaded stem being sized and shaped to extend axially within the bore and to threadingly engage said first threaded nut, with the head disposed above the top surface of the base.

* * * * *